US008025285B2

(12) United States Patent
Hiramitsu et al.

(10) Patent No.: US 8,025,285 B2
(45) Date of Patent: Sep. 27, 2011

(54) SHEET TAKE OUT APPARATUS AND SHEET PROCESSING APPARATUS

(75) Inventors: Naruaki Hiramitsu, Kanagawa-ken (JP); Yoshihiko Naruoka, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 62 days.

(21) Appl. No.: 12/713,872

(22) Filed: Feb. 26, 2010

(65) Prior Publication Data

US 2011/0101599 A1 May 5, 2011

(30) Foreign Application Priority Data

Oct. 30, 2009 (JP) ..... 2009-251178

(51) Int. Cl.
*B65H 3/10* (2006.01)

(52) U.S. Cl. ..... 271/96; 271/94; 271/104; 271/108; 271/112

(58) Field of Classification Search ..... 271/96, 271/94, 104, 108, 112
See application file for complete search history.

(56) References Cited

U.S. PATENT DOCUMENTS 6,773,006 B2 * 8/2004 Andreyka et al. ..... 271/96
2010/0025920 A1 * 2/2010 Williams ..... 271/112

FOREIGN PATENT DOCUMENTS

JP 02243432 A * 9/1990
JP 2001-171854 6/2001
JP 2002046879 A * 2/2002
JP 2007-182318 7/2007
JP 2009227399 A * 10/2009

* cited by examiner

*Primary Examiner* — Stefanos Karmis
*Assistant Examiner* — Luis A Gonzalez
(74) *Attorney, Agent, or Firm* — Pillsbury Winthrop Shaw Pittman, LLP

(57) ABSTRACT

According to one embodiment, a sheet take out apparatus includes a supply table on which sheets are stacked; a detecting portion configured to detect a state of a top surface of the stacked sheets; a cylindrical take out rotor which is rotatably provided so as to face an end portion on a take out side of a top sheet and partially includes a suction hole to attract the sheet, the take out rotor taking out the sheets one by one by attracting the end portion on the take out side of the sheet with rotation; a suction portion which is provided inside the take out rotor and includes an air hole to attract the sheet through the suction hole, the suction portion provided so as to allow the air hole to rotationally move between a first opening position and a second opening position, the first opening position having a first distance away from the end portion on the take out side of the sheet, the second opening position having a second distance, which is longer than the first distance, away from the end portion on the take out side of the sheet; and a drive structure configured to rotationally move the suction portion to any of the first opening position and the second opening position based on state information detected by the detecting portion.

18 Claims, 10 Drawing Sheets

| FIRST SENSOR | SECOND SENSOR | SUPPLY TABLE | OPENING STATE OF AIR HOLE |
|---|---|---|---|
| OFF | OFF | ASCEND | FIRST OPENING STATE (θ1) |
| ON | OFF | STOP | FIRST OPENING STATE (θ1) |
| ON | ON | STOP | SECOND OPENING STATE (θ2) |
| OFF | ON | ASCEND | SECOND OPENING STATE (θ2) |

SHEET TAKE OUT APPARATUS AND SHEET PROCESSING APPARATUS

CROSS-REFERENCE TO RELATED APPLICATION

This application is based upon and claims the benefit of priority from Japanese Patent Application No. 2009-251178, filed on Oct. 30, 2009, the entire contents of all of which are incorporated herein by reference.

TECHNICAL FIELD

The present invention relates to a sheet take out apparatus configured to take out sheets such as marketable securities, and to a sheet processing apparatus including the sheet take out apparatus.

BACKGROUND

A sheet processing apparatus configured to process sheets such as marketable securities includes a sheet take out apparatus, an inspection device, and a sorting apparatus (see Japanese Patent Application Publication No. 2007-182318, for example). The sheet take out apparatus is configured to take out sheets one by one from sheets collectively set. The inspection device is configured to convey and inspect the sheets taken out by the sheet take out apparatus. The sorting apparatus is configured to sort the sheets based on the inspection result made by the inspection device.

The inspection device determines a type of sheet (hereinafter referred to as a sheet type), a conveyance state of the sheet, an authenticity of the sheet, and a negotiability of the sheet. In the determination of the authenticity, the inspection device determines whether the sheet is an authentic sheet or an inauthentic sheet. In the determination of the negotiability, the inspection device determines whether the sheet is a negotiable sheet or a nonnegotiable sheet. The sorting apparatus includes a stacking device and a banding device. The stacking device stacks the sheets sorted based on the determination result made by the inspection device. The banding device bands each predetermined number of sheets by a paper band after the sheets are stacked in the stacking device.

The sheet take out apparatus includes a supply table on which sheets are stacked; a chamber having an air hole; a take out rotor which has a suction hole and rotates around the outer circumference of the chamber; a separation roller; and multiple conveyor rollers and multiple conveyor belts which convey the taken-out sheets. The chamber is fixed in a predetermined position and the air hole is also fixed in a predetermined position (see, for example, Japanese Patent Application Publication No. 2001-171854). A vacuum pump is connected to the chamber, thereby being capable of attracting a sheet through the air hole of the chamber and the suction hole of the take out rotor. Along with every rotation of the take out rotor, a top sheet is attracted to the suction hole and is taken out accordingly. The separation roller has a suction hole on a side facing the take out rotor. The separation roller rotates in a reverse direction to the rotational direction of the take out rotor. When the take out rotor takes out two sheets overlapping each other, the separation roller separates the second sheet from the first sheet by attracting the second sheet. Thus, the separation roller prevents two sheets from being taken out at the same time.

As far as sheets each have an entirely uniform thickness, a top surface of the sheets stacked on the supply table is not inclined. Thus, the top sheet stably comes into contact with the take out rotor and is stably attracted through the suction hole of the take out rotor. However, when sheets each have a partially uneven thickness, or specifically, when the sheets each have a larger thickness in a rear part in a sheet take out direction than in the other part, the top surface of the stacked sheets is inclined with respect to the horizontal plane because a rear end of the top surface is elevated.

In this case, the take out rotor does not stably come into contact with a take-out-side end portion of the top sheet. Thus, the top sheet is likely to fail to be taken out without being attracted to the take out roller through the suction hole of the take out roller. Accordingly, no sheet is taken out until the take out rotor makes another rotation. This makes a take-out pitch longer, and thus deteriorates a take out processing rate. Moreover, if the take out rotor repeatedly fails to come into contact with sheets, it is determined that the sheets cannot be taken out. Consequently, the operation of the apparatus is stopped.

SUMMARY

An object of the present invention is to provide a sheet take out apparatus capable of stably taking out sheets regardless of a stacked state of the sheets and a sheet processing apparatus including the sheet take out apparatus.

An aspect of the present disclosure relates to a sheet take out apparatus containing: a supply table on which sheets are stacked; a detecting portion configured to detect a state of a top surface of the stacked sheets; a cylindrical take out rotor which is rotatably provided so as to face an end portion on a take out side of a top sheet and partially includes a suction hole to attract the sheet, the take out rotor configured to take out the sheets one by one by attracting the end portion on the take out side of the sheet with rotation; a suction portion which is provided inside the take out rotor and includes an air hole to attract the sheet through the suction hole, the suction portion provided so as to allow the air hole to rotationally move between a first opening position and a second opening position, the first opening position having a first distance away from the end portion on the take out side of the sheet, the second opening position having a second distance, which is longer than the first distance, away from the end portion on the take out side of the sheet; and a drive structure configured to rotationally move the suction portion to any of the first opening position and the second opening position based on state information detected by the detecting portion.

Another aspect of the present disclosure relates to a sheet processing apparatus containing: a sheet take out apparatus configured to take out supplied sheets one by one; a sheet inspection device configured to inspect the sheets taken out by the sheet take out apparatus; and a sheet sorting apparatus configured to sort the sheets based on an inspection result made by the sheet inspection device, the sheet take out apparatus including: a supply table on which the sheets are stacked; a detecting portion configured to detect a state of a top surface of the stacked sheets; a cylindrical take out rotor which is rotatably provided so as to face an end portion on a take out side of the top sheet and partially includes a suction hole to attract the sheet, the take out rotor configured to take out the sheets one by one by attracting the end portion on the take out side of the sheet with rotation; a suction portion which is provided inside the take out rotor and includes an air hole to attract the sheet through the suction hole, the suction portion provided so as to allow the air hole to rotationally move between a first opening position and a second opening position, the first opening position having a first distance away from the end portion on the take out side of the sheet, the second opening position having a second distance, which is longer than the first distance, away from the end portion on the take out side of the sheet; and a drive structure configured to rotationally move the suction portion to any of the first opening position and the second opening position based on state information detected by the detecting portion.

DESCRIPTION OF THE DRAWINGS

FIG. 10, is a flowchart showing how to take out a sheet by using the sheet take out apparatus.

DETAILED DESCRIPTION

Figure 1:
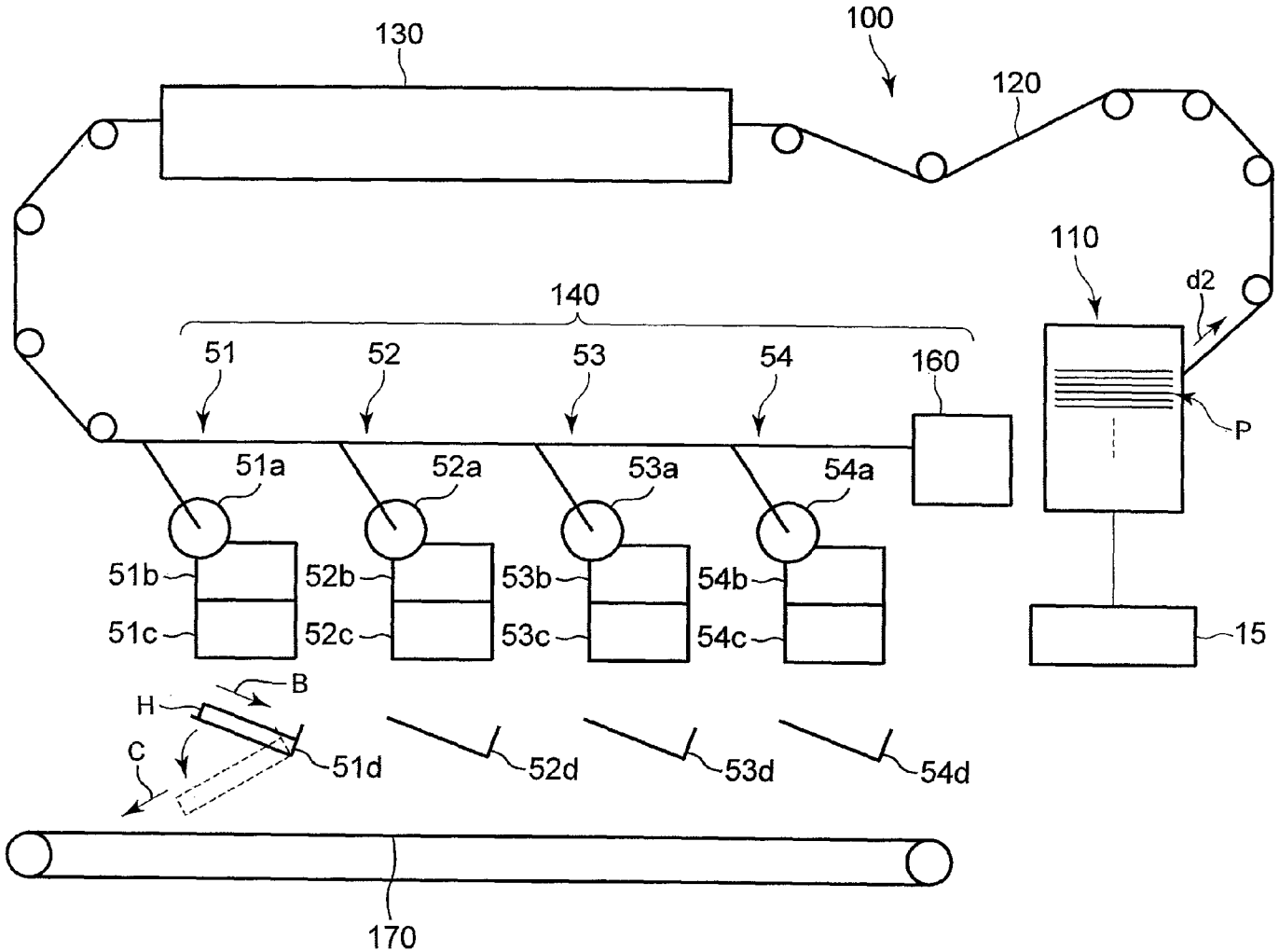
FIG. 1 is a side view schematically showing a sheet processing apparatus according to an embodiment of the present invention.

A sheet processing apparatus according to an embodiment of the present invention is described below in detail by referring to the drawings. As shown in FIG. 1, a sheet processing apparatus 100 includes a sheet take out apparatus 110 configured to take out supplied sheets P one by one; a conveyor device 120 configured to convey the sheets P which are taken out one by one at regular intervals by the sheet take out apparatus 110; a sheet inspection device 130 configured to inspect the sheets which are being conveyed; and a sheet sorting apparatus 140 configured to sort and stack the inspected sheets.

The sheet inspection device 130 performs processing such as determination of a sheet type, authenticity, negotiability of the sheets P which are being conveyed by the conveyor device 120 and inspection of a printed condition of the sheet. Also, the sheet inspection device 130 determines sheets which are conveyed in an unusual manner or two sheets which are taken out together as sheets incapable of inspection.

The sheet sorting apparatus 140 sorts the sheet P based on the inspection result made by the sheet inspection device 130. The sheet sorting apparatus 140 includes multiple staking/banding devices 51 to 54 and an eject sheet stacker 160. The staking/banding devices 51 to 54 are arranged in line along the terminal portion of the conveyance path. For example, negotiable sheets are sorted according to each sheet type to be sent to and nonnegotiable sheets are sent to corresponding storing/banding devices. The eject sheet stacker 160 is provided in the end of the conveyance path of the conveyor device 120, and the ejected sheets are stacked in the eject sheet stacker 160.

The stacking/banding device 51 includes a bladed wheel 51*a*, a stacker 51*b*, a banding portion 51*c*, and a chute portion 51*d*. The bladed. wheel 51*a* rotates in synchronization with the conveyance of the sheet P The bladed wheel 51*a* captures the conveyed sheet P and stacks the sheet P in the stacker 51*b*. In the stacker 51*b*, negotiable sheets or nonnegotiable sheets are temporarily stacked based on the inspection result made by the sheet inspection device 130. The banding portion 51*c* bundles the stacked sheets P in the stacker 51*b*, by using a paper band when the number of the stacked sheets P becomes 100, for example. The chute portion 51*d* captures the bundle of the 100 sheets (hereinafter referred to as a bundle H) to send out the bundle H in the C direction to a conveyor 170.

The stacking/banding devices 52 to 54 have the same configuration as the stacking/banding device 51. In the present embodiment, the stacking/banding devices 51 and 52 stack and bundle negotiable sheets, while the stacking/banding devices 53 and 54 stack and bundle nonnegotiable sheets.

Figure 2:
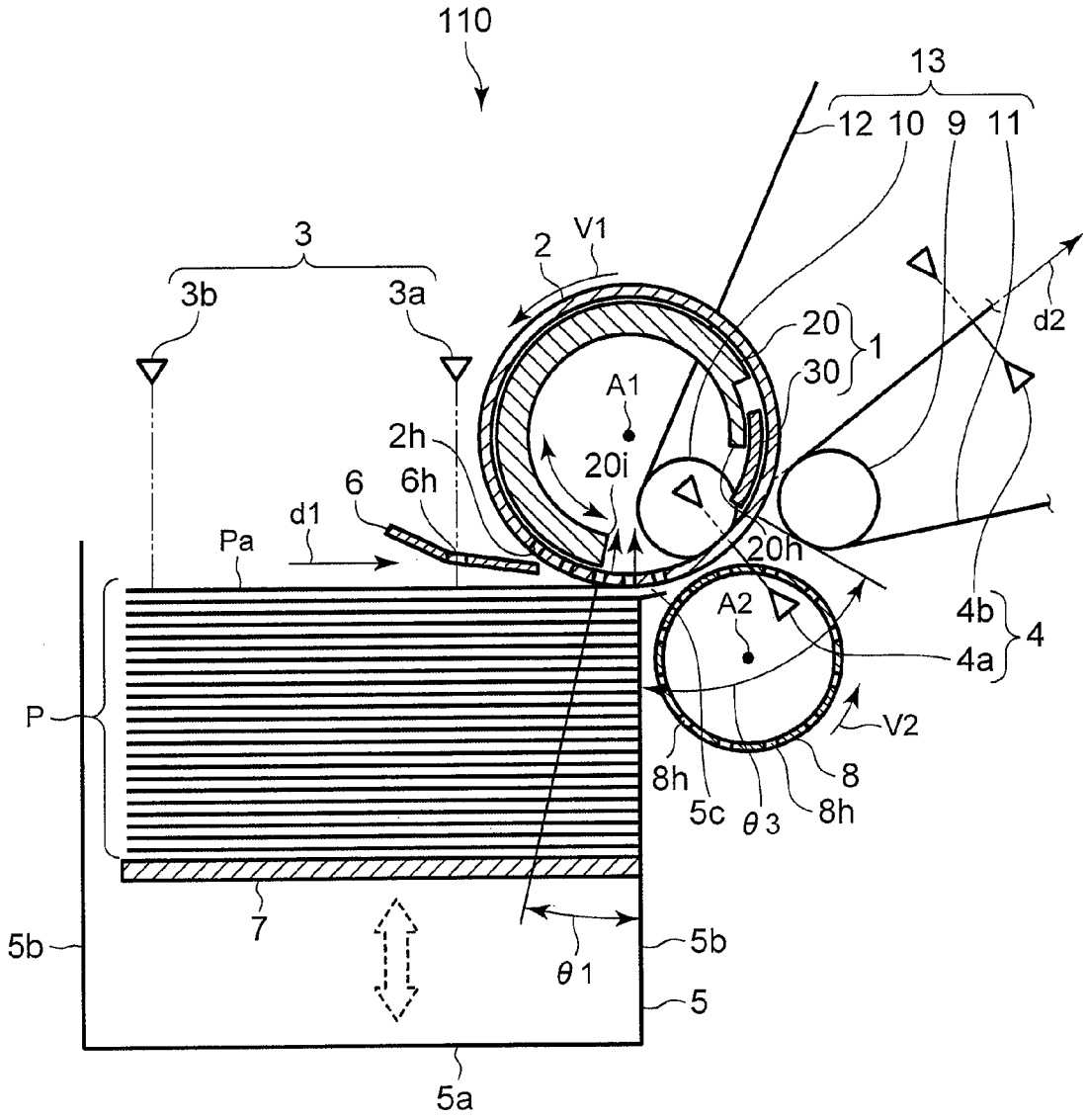
FIG. 2 is a cross-sectional view of a sheet take out apparatus in a state where an air hole is set in a first opening portion.

As shown in FIG. 2, the sheet take out apparatus 110 includes a supply box 5 configured to accommodate the sheets P in a stacked state; a supply table 7 which is provided inside the supply box 5 and on which the sheets P are placed; a detecting portion 3 configured to detect the stacked state of the sheets P; a take out rotor 2 configured to take out the sheet P; a suction portion 1 configured to provide suction force to the take out rotor 2; a separation roller 8; two pairs of conveyor portions 13; a detecting portion 4 configured to detect the taken-out sheet P; and a controller 15 configured to control the operation of the sheet take out apparatus 110 (see FIG. 1).

The supply box 5 is formed in a box shape having a rectangular cross section corresponding to the shape of the sheet P. The supply box 5 has a substantially horizontal bottom wall 5*a*, four side walls 5*b* which are substantially vertically set up, and a top end opening. One end of the top end opening, for example, the right end in FIG. 2 forms a take-out port 5*c* for the sheet P. The supply table 7 is provided inside the supply box 5 and above the bottom wall. The supply table 7 is moved up and down in the vertical direction by an unillustrated lifting mechanism. A large number of sheets P are stacked inside the supply box 5 being placed on the supply table 7 in a stacked state. The sheets P are stacked so that the longitudinal direction thereof extends in a take out direction d1 of the sheet P.

A guide plate 6 is provided above the supply table 7 and in an upstream side, in the take out direction, of the take-out port 5*c*. The guide plate 6 is positioned so as to face a top sheet Pa to guide the sheets P to the take out rotor 2. The surface of the top sheet Pa is the top surface of the sheets P. The guide plate 6 restricts the upward movement of the sheets P and keeps the stacked state of the sheets P. The guide plate 6 has substantially the same size as the sheets P in the width direction of the sheets P. In addition, the guide plate 6 has a detection through-hole 6*h* formed in one portion thereof.

The detecting portion 3 detects the state (position) of the top sheet Pa and the stacked state of the sheets P, particularly, an inclination of the top sheet Pa. Note that if the top sheet Pa is inclined, the tip end, in the take out direction, of the top sheet Pa is less likely to come into close contact with the take out rotor 2 when the top sheet Pa comes into contact with the guide plate 6. The detecting portion 3 has a first sensor 3*a* and a second sensor 3*b* which are provided above the sheet P and are spaced apart from each other along the take out direction d1. The first and second sensors 3*a* and 3*b* are, for example, reflection sensors. The first and second sensors 3*a* and 3*b* detect state information (positional information) in two points on the top sheet Pa, the two points spaced apart from each other along the take out direction d1.

The first sensor 3*a* emits light to the end portion, on the take-out port 5*c* side, of the top sheet Pa through the through-hole 6*h* of the guide plate 6 and then detects light reflected by the sheet P through the through-hole 6*h*. The second sensor 3*b* emits light to a rear end side, in the take out direction d1, of the top sheet Pa and then detects light reflected by the sheet Pa.

Figure 3:
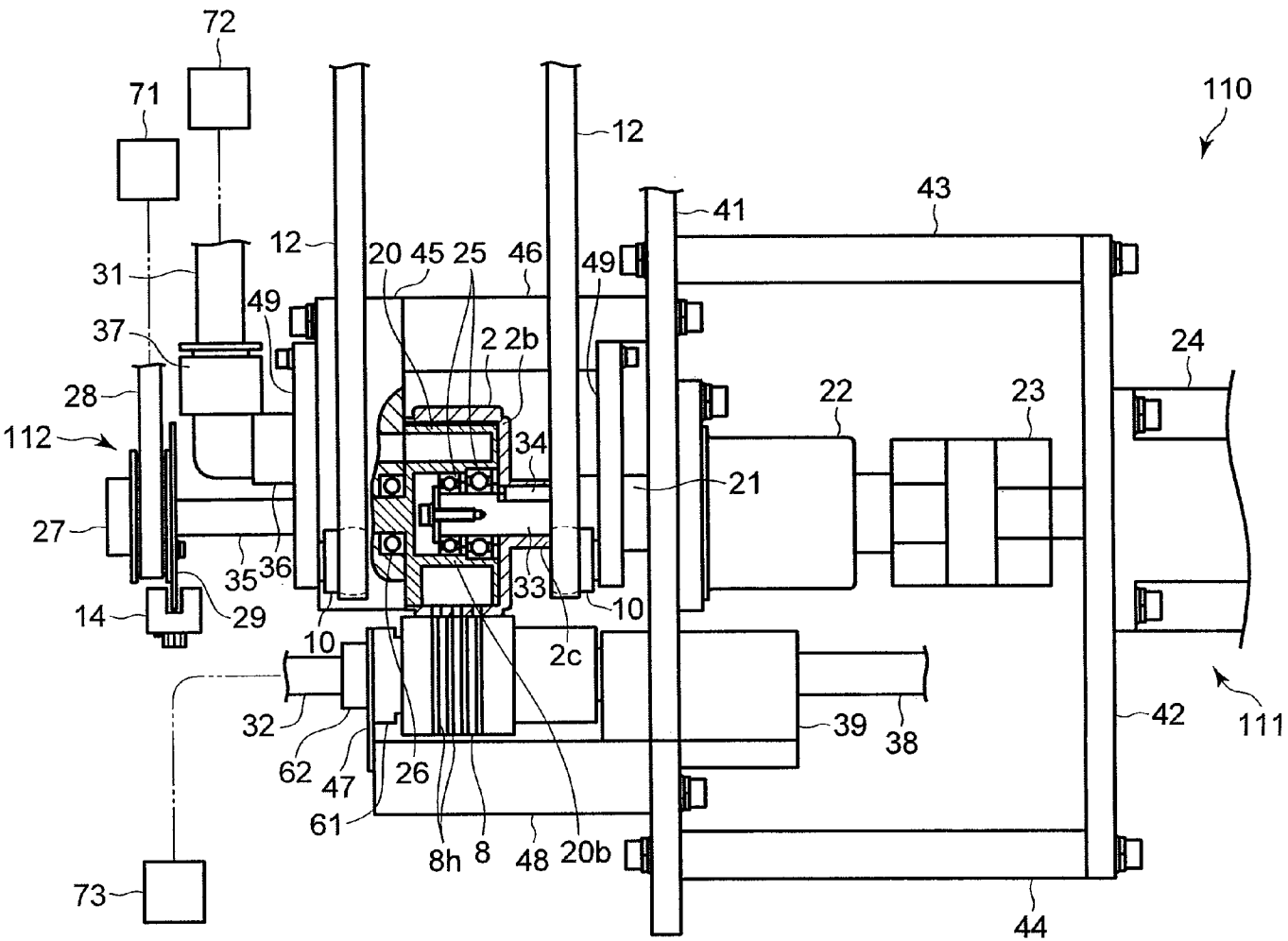
FIG. 3 is a front view showing the sheet take out apparatus.
Figure 4:
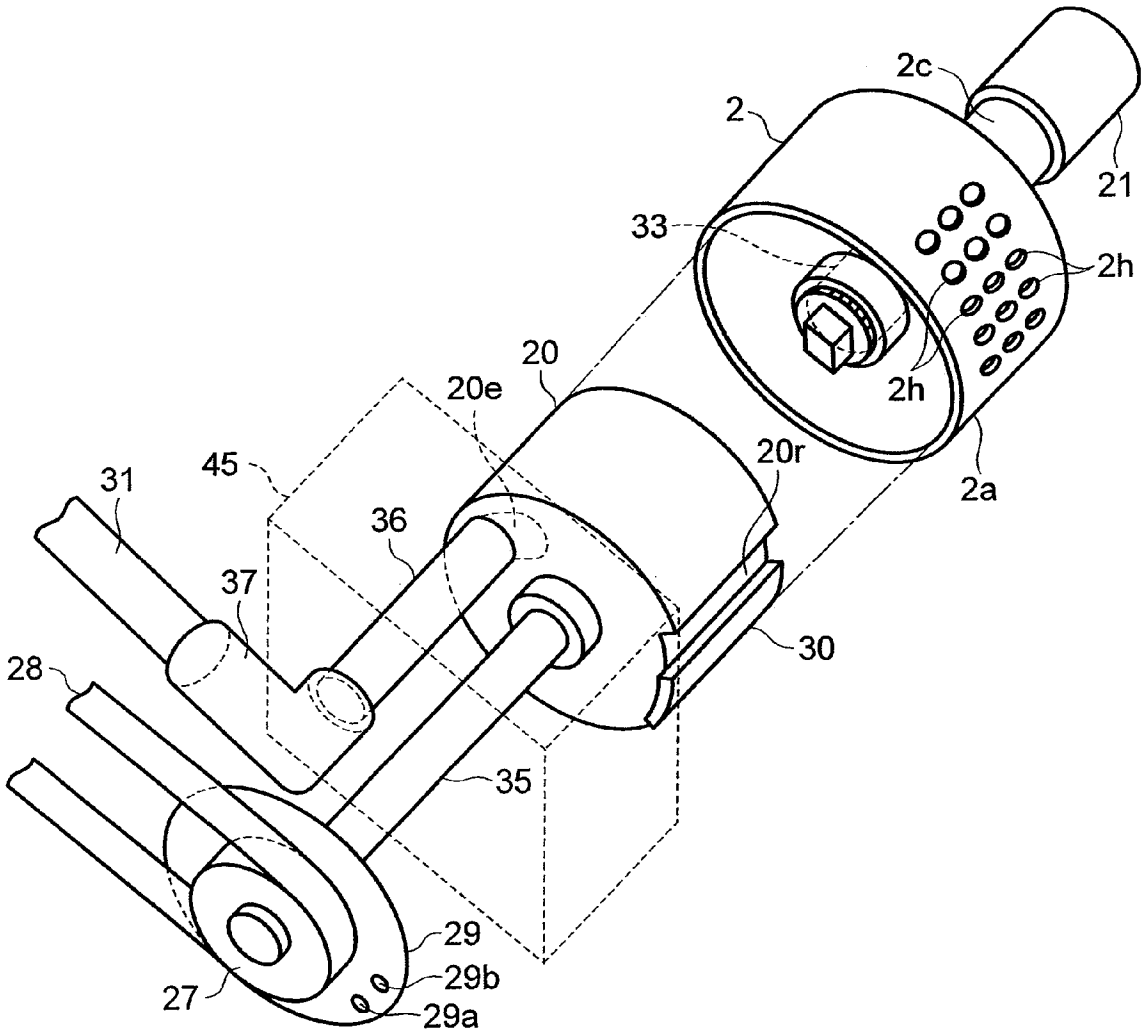
FIG. 4 is an exploded perspective view showing one part of the sheet take out apparatus.
Figure 5:
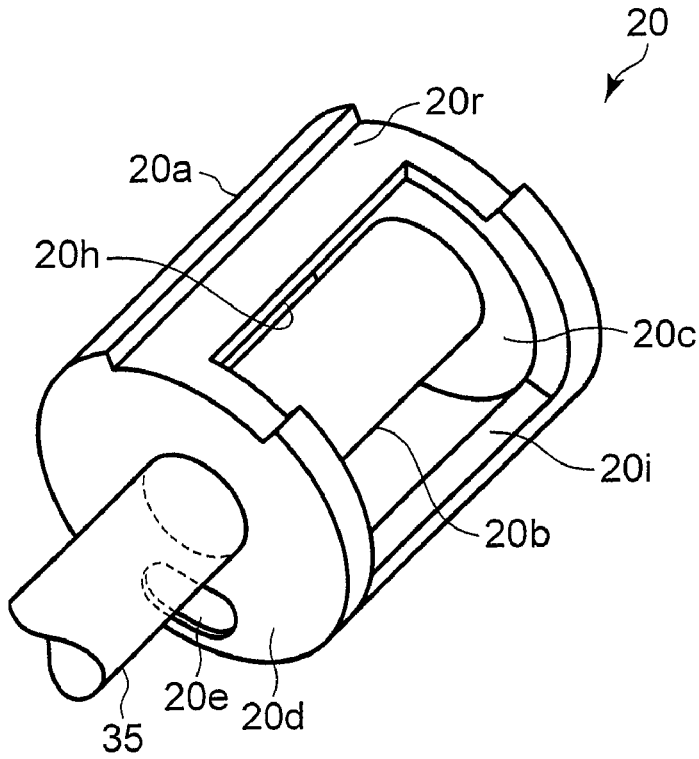
FIG. 5 is a perspective view showing a chamber of the sheet take out apparatus.

As shown in FIGS. 2 to 4, the take out rotor 2 is provided in a vicinity of the take-out port 5*c* of the supply box 5 so as to be capable of making rolling contact with the end portion, on the take out side, of the top sheet Pa. The take out rotor 2 is supported so as to be rotatable around a central axis A1 extending in a direction substantially parallel with the width direction of the sheets P.

The take out rotor 2 integrally includes a cylindrical main body 2*a*, an end wall 2*b* to block one end of the main body 2*a*, and a cylindrical supporting portion 2*c* projecting from the end wall 2*b* so as to be coaxial with the main body 2*a*. The main body 2*a* has multiple suction holes 2*h* formed in portions in the circumferential direction in, for example, a matrix form of three columns and five rows.

The take out rotor 2 is fixed in a tip portion 33 of the rotational axis 21 and is caused to rotate by the rotational axis 21. The rotational axis 21 extends in a direction substantially parallel with the width direction of the stacked sheets P. A housing 22 is fixed to a support frame 41 and an unillustrated bearing is provided inside the housing 22. A drive motor 24 is attached to a support frame 42. The support frames 41 and 42 are provided so as to face each other and be spaced apart from each other. The support frames 41 and 42 are connected with each other through multiple connection rods 43 and 44. The center portion, in the longitudinal direction, of the rotational axis 21 is rotatably supported by the bearing inside the housing 22. The base end of the rotational axis 21 is connected with an output axis of the drive motor 24 through a coupling 23.

The supporting portion 2*c* of the take out rotor 2 is fitted into and fixed to the outer circumference of the tip portion 33 of the rotational axis 21. Key ways are formed respectively in the inner circumferential surface of the supporting portion 2*c* and in the outer circumferential surface of the tip portion 33, and a key 34 is thus fitted into the key ways. In this manner, the take out rotor 2 is fixed to the rotational axis 21 so as to be rotatable together with the rotational axis 21. The tip portion 33 of the rotational axis 21 projects to the inside of the main body 2*a* of the take out rotor 2 and is positioned so as to be coaxial with the main body 2*a*. Two ball bearings 25 are fitted into the outer circumference of the tip portion 33. These ball bearings 25 are positioned and fixed by washers fastened by bolts to the tip end of the rotational axis 21. A chamber 20 to be described later is fitted into the outer ring of the ball bearings 25. Accordingly, the rotational axis 21 is supported by the ball bearings 25 and the bearing inside the housing 22. The rotational axis 21, the housing 22, the coupling 23, and the drive motor 24 constitute a first drive structure 111 that rotates the take out rotor 2.

When the drive motor 24 operates, the rotational axis 21 and the take out rotor 2 rotate through the coupling 23. The take out rotor 2 rotates in the state where the outer circumferential surface of the main body 2*a* is in contact with the top sheet Pa. For a predetermined period of time during the rotation of the take out rotor 2, the suction holes 2*h* face the top sheet Pa. The take out rotor 2 rotates in the state where the top sheet Pa is attached to the take out rotor 2, so that the top sheet Pa can be taken out one by one from the sheets P in the supply box 5.

As shown in FIGS. 2 to 5, the suction portion 1 which provides the suction force to the take out rotor 2 includes the chamber 20 which is provided inside the take out rotor 2. The chamber 20 has an outer tube 20*a*, an inner tube 20*b* which is provided inside the outer tube 20*a* and is coaxially positioned with the outer tube 20*a*, a ring-shaped side wall 20*c* blocking one end of the outer tube 20*a*, and a disc-shaped side wall 20*d* blocking the other ends of the outer tube 20*a* and the inner tube 20*b*. The outer tube 20*a*, the inner tube 20*b*, the ring-shaped side wall 20*c* and the disc-shaped side wall 20*d* are integrally formed. A suction space is formed between the outer tube 20*a* and the inner tube 20*b*. The external diameter of the outer tube 20*a* is designed slightly smaller than the inner diameter of the take out rotor 2.

The outer tube 20*a* has an air hole 20*h* formed therein. The air hole 20*h* opens throughout almost the entire length, in the axial direction, of the outer tube 20*a* and opens in a predetermined angular range in the circumferential direction of the outer tube 20*a*. A guide groove 20*r* formed in the outer circumferential surface of the outer tube 20*a* extends throughout the entire length in the axial direction of the outer tube 20*a* and extends in a predetermined angular range in the circumferential direction of the outer tube 20*a*. One portion of the guide groove 20*r* is formed so as to overlap one end portion of the air hole 20*h*. An exhaust opening 20*e* for exhausting air inside the suction space in the chamber 20 is formed in the side wall 20*d* of the chamber 20.

A drive shaft 35 is fixed to the side wall 20*d* of the chamber 20 and extends coaxially with the chamber 20 from the side wall 20*d*. The chamber 20 is provided inside the main body 2*a* of the take out rotor 2 so as to be coaxial with the take out rotor 2. The inner tube 20*b* of the chamber 20 is fitted into the outer rings of the ball bearings 25 and is rotatably supported by these ball bearings 25.

The drive shaft 35 is supported by a support frame 45 and extends coaxially with the rotational axis 21 of the take out rotor 2. An axle bearing 26 is attached to the support frame 45 and is positioned on the outer circumference side of the drive shaft 35. One bearing washer of the axle bearing 26 is fixed to the support frame 45 and the other bearing washer is fitted into the outer circumference of the drive shaft 35 in the state of being in contact with the side wall 20*d* of the chamber 20. Accordingly, the weight of the chamber 20 in the thrust direction is supported by the axle bearing 26. Note that the support frame 45 faces the support frame 41 in parallel therewith and is spaced apart from the support frame 41. The support frame 45 is connected with the support frame 41 through a connection rod 46.

The drive shaft 35 extends through a through-hole formed in the support frame 45, and has a drive pulley 27 attached in a projected end of the drive shaft 35. A drive belt 28 is wound around the drive pulley 27 and the rotational axis of the drive motor 71. Accordingly, by operating the drive motor 71 to rotate the drive shaft 35 through the drive belt 28 and the drive pulley 27, the chamber 20 can be rotated by a predetermined angle inside the take out rotor 2.

An exhaust pipe 36 is attached to the support frame 45 and extends in a direction substantially parallel with the drive shaft 35. One end of the exhaust pipe 36 is connected with a vacuum pump 72 through a connector 37 and a pipe arrangement 31. The other end of the exhaust pipe 36 closely faces the exhaust opening 20*e* formed in the side wall 20*d* of the chamber 20. By operating the vacuum pump 72, the inside of the chamber 20 is evacuated through the pipe arrangement 31, the exhaust pipe 36, and the exhaust opening 20*e*, so that outer air is vacuumed from the air hole 20*h* of the chamber 20. Note that the exhaust opening 20*e* is formed in an arc-shaped long hole so as to always face an end of the exhaust pipe 36 even when the chamber 20 rotates within a predetermined angular range. For this reason, the suction portion 1 attracts the sheet P through the air hole 20*h* and the suction holes 2*h* of the take out rotor 2, thereby being capable of attracting the sheet P to the take out rotor 2.

As shown in FIG. 2, the chamber 20 is provided so that the air hole 20*h* thereof would be positioned above the take-out port 5*c* of the supply box 5 and would be positioned to face the end portion on the take out side of the top sheet Pa with the take out rotor 2 interposed in between. By rotating the chamber 20, the air hole 20*h* can be shifted to any of a first opening position shown in FIG. 2 and a second opening position shown in FIG. 7. The drive shaft 35, the drive pulley 27, the drive belt 28, and the drive motor 71 constitutes a second drive structure 112 that moves the suction portion 1 to any of the first opening position and the second opening position.

When the suction portion 1 is in the first opening position shown in FIG. 2, one end 20*i* of the air hole 20*h*, i.e., one end 20*i* which is located on the rear end side of the sheet Pa, is positioned so that the line passing the central axis A1 of the chamber 20 and the one end 20*i* is inclined at a first angle θ1 toward the rear end of the sheet Pa with respect to the perpendicular passing the central axis A1 and the take-out port 5*c*. The air hole 20*h* faces the end portion on the take out side of the top sheet Pa within an angular range of the first angle θ1. When the suction portion 1 is in the first opening position, the one end 20*i* of the air hole 20*h* has a first distance away from the end portion on the take out side of the top sheet Pa.

Figure 7:
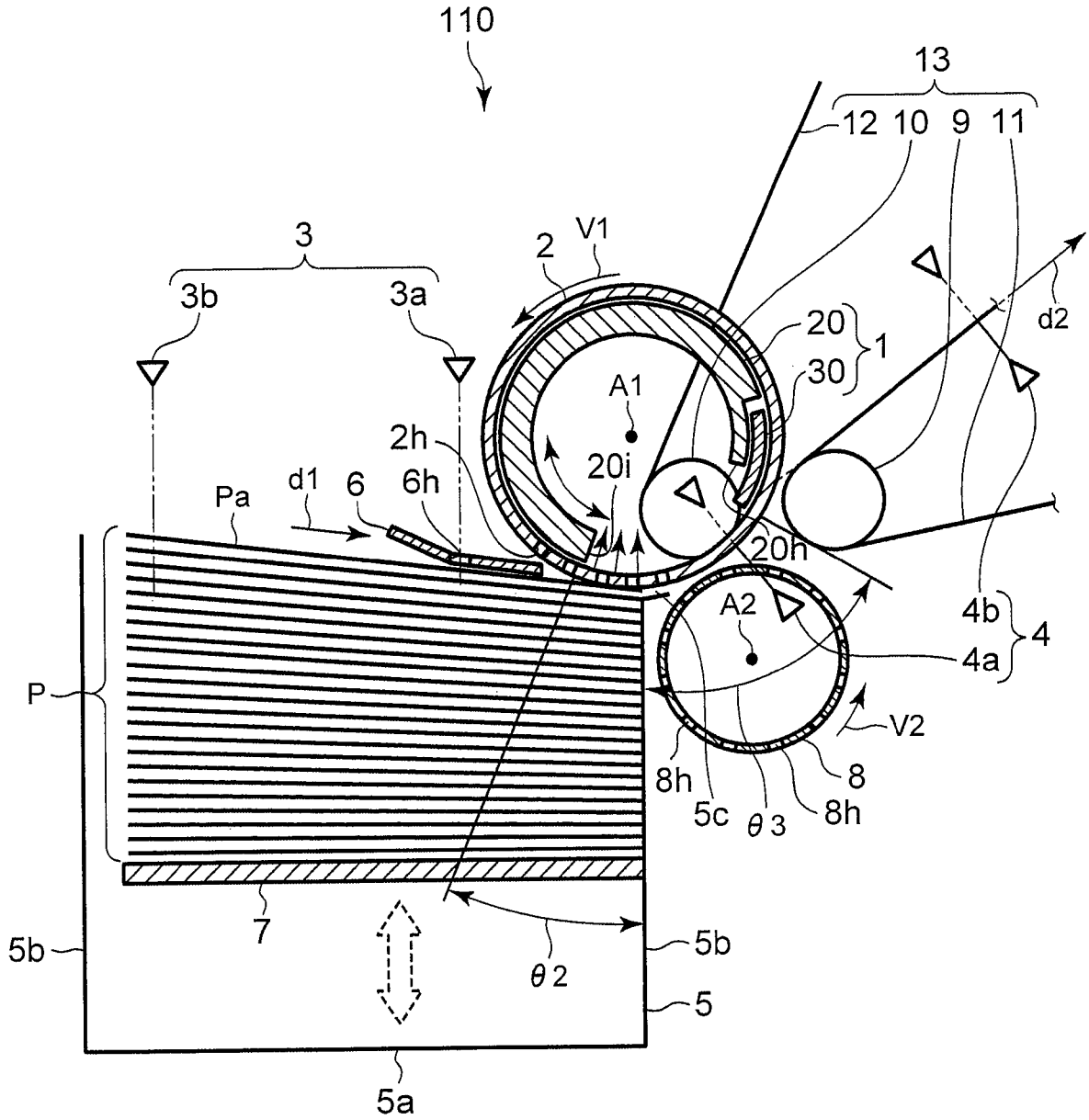
FIG. 7 is a cross-sectional view of the sheet take out apparatus in a state where the air hole is set in a second opening position.

As shown in FIG. 7, when the chamber 20 is rotationally moved to the second opening position, the one end 20*i* of the air hole 20*h* is positioned so that the line passing the rotational axis A1 and the one end 20*i* is inclined at a second angle θ2, which is larger than the first angle θ1, toward the rear end of the sheet Pa with respect to the perpendicular passing the central axis A1 and the take-out port 5*c*. The air hole 20*h* faces the end portion on the take out side of the top sheet Pa within an angular range of the second angle θ2. In other words, when the suction portion 1 is in the second opening position, the suction 20*h* faces the end portion of the top sheet Pa in a wider range than the air hole 20*h* in the first opening position does. Here, the second angle θ2 is set in a range from the first angle θ1+10° to the first angle θ1+20°, for example.

When the suction portion 1 is in the second opening position, the one end 20*i* of the air hole 20*h* has a second distance, which is longer than the first distance, away from the end portion on the take out side of the sheet Pa. The position of the sheet Pa facing the one end 20*i* in the second opening position is closer to the rear end side of the sheet Pa than the position of the sheet Pa facing the one end 20*i* in the first opening position.

On the other hand, when the suction portion 1 is in any of the first and second opening positions, because of the existence of a regulation member 30, the other end of the air hole 20*h*, i.e., an end farther from the take-out port 5*c* in the take out direction is positioned in such a location that the line passing the central axis A1 and the other end is inclined at a third angle θ3 in the take out direction d1 of the sheet P with respect to the perpendicular.

As shown in FIGS. 2, 4, and 7, the suction portion 1 has the regulation member 30 fixed in the support frame 45. The regulation member 30 is a plate and has the same arc-shaped cross section which is concentric with the chamber 20. The regulation member 30 extends inside the guide groove 20*r* of the chamber 20 from the support frame 45 and is interposed between the outer circumferential surface of the chamber 20 and the inner circumferential surface of the take out rotor 2. The regulation member 30 has the same shape as one portion of the chamber 20. The regulation member 30 is fixed and the chamber 20 is rotatable with respect to the regulation member 30. In addition, when the chamber 20 is in any of the first and second opening positions, the regulation member 30 blocks an opening portion of the air hole 20*h*, the opening portion exceeding the range of the third angle θ3. The regulation member 30 thus regulates the suction region in the take out direction d1.

As described above, when the chamber 20 is shifted to the first opening position, the air hole 20*h* opens in the range from the first angle θ1 to the third angle θ3. Similarly, when the chamber 20 is shifted to the second opening position, the air hole 20*h* opens in the range from the second angle θ, which is larger than the first angle θ1, to the third angle θ3. Then, the take out rotor 2 rotates around the outer circumference of the chamber 20 and thus attracts the sheet Pa when the suction holes 2*h* meet with the air hole 20*h* of the chamber 20. The take out rotor 2 rotates with the sheet Pa attracted thereto to take out the attracted sheet Pa in the take out direction d1. Then, the take out rotor 2 further rotates and loses the suction force when the suction holes 2*h* come apart from the air hole 20*h* of the chamber 20. At this time, the sheet P comes off the take out rotor 2 and is sent toward conveyor rollers to be described later.

Figure 6:
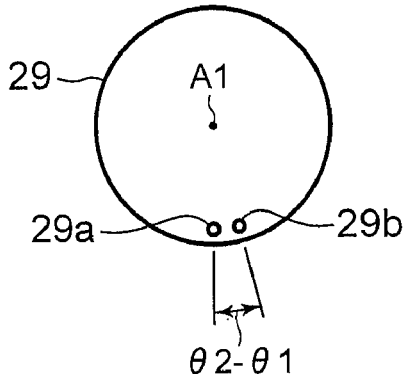
FIG. 6 is a front view of an enlarged shield plate of the sheet take out apparatus.

As shown in FIGS. 3, 4, and 6, a shield plate 29 and a third sensor 14 are provided for detecting the rotational position of the chamber 20. The disc-shaped shield plate 29 is fixed coaxially with the end portion of the drive shaft 35. In the outer circumferential portion of the shield plate 29, two through-holes 29*a* and 29*b* are formed, for example. These through-holes 29*a* and 29*b* are positioned to be spaced apart from each other in the circumferential direction. In the shield plate 29, the line connecting between the central axis A1 and the through-hole 29*a* and the line connecting between the central axis A1 and the through-hole 29*b* form an angle of θ2-θ1 on the inner side.

The third sensor 14 is provided in the vicinity of the through-holes 29*a* and 29*b* so as to face the outer circumferential portion of the shield plate 29. The third sensor 14 detects the through-holes 29*a* and 29*b* to thus detect the rotational position of the chamber 20. For example, the third sensor 14 is formed of a photo-interrupter. When the chamber 20 rotationally moves to the first opening position and the shield plate 29 rotationally moves in conjunction with the chamber 20, the third sensor 14 detects the through-hole 29*a* corresponding to the first opening position. Similarly, when the chamber 20 rotationally moves to the second opening position and the shield plate 29 rotationally moves in conjunction with the chamber 20, the third sensor 14 detects the through-hole 29*b* corresponding to the second opening position.

As shown in FIGS. 2 and 3, the separation roller 8 is provided in the vicinity of the take-out port 5*c* of the supply box 5 so as to face the take out rotor 2. The separation roller 8 has a hollow cylindrical shape and is rotatable around a central axis A2 which is parallel with the central axis A1. The separation roller 8 rotates in a direction reverse to the rational direction of the take out rotor 2 in the portion where the separation roller 8 and the take out rotor 2 face each other. Multiple suction holes 8*h* are formed throughout the entire circumference of the separation roller 8.

One end, in the axial direction, of the separation roller 8 is fixed in a drive shaft 38. The drive shaft 38 is rotatably supported by an unillustrated bearing which is provided inside a housing 39 fixed to the support frame 41. The drive shaft 38 is connected with a drive motor through an unillustrated coupling. Accordingly, when the drive motor operates, the separation motor 8 is caused to rotate.

A chamber 61 is inserted into the inside of the separation roller 8. The chamber 61 has an unillustrated air hole facing the take out rotor 2. The chamber 61 is fixed to a support frame 47 and is supported by the support frame 41 through the support frame 47 and a stay 48.

The chamber 61 has a vacuum pump 73 connected thereto through a connector 62 and a pipe arrangement 32. The vacuum pump 73 evacuates the inside of the chamber 61, and thus the sheet P is attracted through the air hole of the chamber 61 and the suction holes 8*h* of the separation roller 8. In this manner, when the take out rotor 2 takes out two sheets P overlapping each other at the same time, the separation roller 8 attracts the second sheet P and sends the attracted sheet P to a direction reverse to the take out direction d1. As a result, the second sheet P can be separated from the first sheet P.

As shown in FIGS. 2, 3, and 7, each conveyor portion 13 is provided on both sides, in the direction along the central axis A1, of the suction portion 1. Each conveyor portion 13 has conveyor rollers 9 and 10 and conveyor belts 11 and 12. The conveyor belt 11 is wound around the conveyor roller 9. The conveyor belt 12 is wound around the conveyor roller 10. Each of the conveyor belts 11 and 12 serves as a conveying path extending in a conveying direction d2.

In the conveying path, the conveyor belts 11 and 12 come into contact with each other. In the conveyor portion 13, the conveyor belts 11 and 12 sandwich the sheet P taken out by the take out rotor 2 therebetween to convey the sheet P in a conveying direction d2.

The conveyor roller 10 is rotatably supported by support frames 49. One support frame 49 is supported by the support frame 45, while the other support frame 49 is supported by the connection rod 46.

As shown in FIGS. 2 and 7, the detecting portion 4 has fourth and fifth sensors 4*a* and 4*b* that detect the sheep P taken out. The fourth and fifth sensors 4*a* and 4*b* are arranged in line along the conveying direction so as to be spaced apart from each other. Each of the fourth and fifth sensors 4*a* and 4*b* detects positional information of the tip end of the sheet P taken out.

As shown in FIGS. 1, 2, and 7, a controller 15 controls the detecting operation of the detecting portion 3, the operation of the supply table 7, the rotational operation of the chamber 20, and the operation of the take out rotor 2. The controller 15 controls the supply table 7 to ascend or descend based on the positional information of the top sheet Pa detected by the detecting portion 3. The controller 15 also detects an inclination of the top sheet Pa. When it is detected that the top sheet Pa is inclined so that the rear end portion side of the sheet Pa is higher than the end portion on the take out side of the sheet Pa, the controller 15 rotationally moves the chamber 20 to the second opening position. On the other hand, when the paper Pa is in other states, for example, when the sheet Pa is substantially horizontal, or when the top sheet Pa is inclined so that the end portion on the take out side of the sheet Pa is higher than the rear end portion side of the sheet Pa, the controller 15 rotationally moves the chamber 20 to the first opening position.

As shown in FIGS. 1, 2, 7, and 8, the first sensor 3*a* is turned on when the height of the end portion on the take out side of the top sheet Pa is equal to or higher than a reference value. On the other hand, the first sensor 3*a* is turned off when the height of the end portion on the take out side of the top sheet Pa is lower than the reference value. When the first sensor 3*a* is turned off, the controller 15 causes the supply table 7 to ascend. On the other hand, when the first sensor 3*a* is turned on, the controller 15 causes the supply table 7 to stop ascending. In this manner, the controller 15 sets the stacked sheets P to a proper height position for taking out the sheets P.

The second sensor 3*b* is turned on when the height of the rear end portion of the top sheet Pa is equal to or higher than a reference value. On the other hand, the second sensor 3*b* is turned off when the height of the rear end portion of the top sheet Pa is lower than the reference value. When the second sensor 3*a* is turned off, the controller 15 sets the chamber 20 to the first opening position. On the other hand, when the second sensor 3*b* is turned on, the controller 15 sets the chamber 20 to the second opening position.

The first and second sensors 3*a* and 3*b* only need to detect the height of the top sheet Pa every time the number of sheets P thus taken out reaches 20, for example. In this case, the supply table 7 only needs to ascend or stop ascending every time the number of sheets P thus taken out reaches 20.

The controller 15 calculates a speed of taking out the sheet P based on the positional information of the tip end of the sheet P detected by the detecting portion 4. The controller 15 controls a rotating speed V1 of the take out rotor 2 based on the calculated take out speed. When the sheet P is taken out at a constant speed, the controller 15 sets the rotating speed V1 of the take out rotor 2 to be constant. In the case of a constant gap take out where the sheet P is taken out in such a manner that a gap between two consecutive sheets P becomes constant, the controller 15 increases or decreases the rotating speed V1 of the take out rotor 2 to thus accelerate or decelerate the rotation of the take out rotor 2. Note that a rotating speed V2 of the separation roller 8 is set to be constant.

Figures 8, 9:
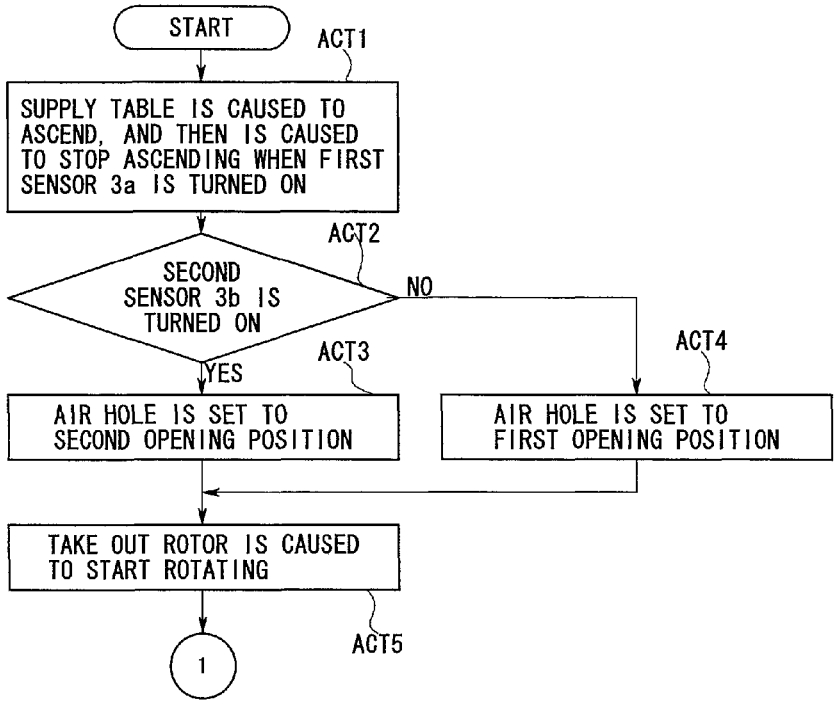
FIG. 8 is a table showing movements of a supply table and opening states of the air hole corresponding to the states whether first and second sensors are turned on or off.
FIG. 9 is a flowchart showing how to take out a sheet by using the sheet take out apparatus.

Hereinafter, a description will be give of a method of taking out a sheet by the sheet take out apparatus 110 configured as described above. In particular, the control method of the controller 15 is described. Refer to FIGS. 2, 7, and 9. When a large number of sheets P supplied inside the supply box 5 and stacked on the supply table 7 are started to be taken out, the controller 15 causes the supply table 7 to ascend, first of all in ACT1. When the first sensor 3*a* is switched on, the controller 15 causes the supply table 7 to stop ascending. In this manner, the top sheet Pa of the stacked sheets P is set to a height position which allows the sheet Pa to be taken out.

After that, in ACT2, the controller 15 determines if the second sensor 3*b* is turned on. When the second sensor 3*b* is turned on, in ATC3, the controller 15 operates the drive motor 71 and rotationally moves the chamber 20 to the second opening position. Thereafter, in ACT5, the controller 15 operates the drive motor 24 to start the rotation of the take out rotor 2. At the same time, the controller 15 controls the separation roller 8 to rotate at a constant speed and controls the vacuum pump 72 for suction portion 1 and the vacuum pump 73 for the separation roller to operate. In this manner, suction is started.

When the second sensor 3*b* is not turned on (in ACT2), the controller 15 operates the drive motor 24 to move the chamber 20 to the first opening position. After that, the step proceeds to ACT5. At this time, the controller 15 detects the first and second opening positions of the chamber 20 based on detection signals from the third sensor 14, so that the drive motor 24 is controlled to be driven or stopped.

As a result, the end portion on the take-out port 5*c* side of the top sheet Pa is attracted to the take out rotor 2. Then, the sheet Pa is taken out from the supply box 5 by the rotating take out rotor 2 and is sent to the conveyor belts 11 and 12.

Figure 10:
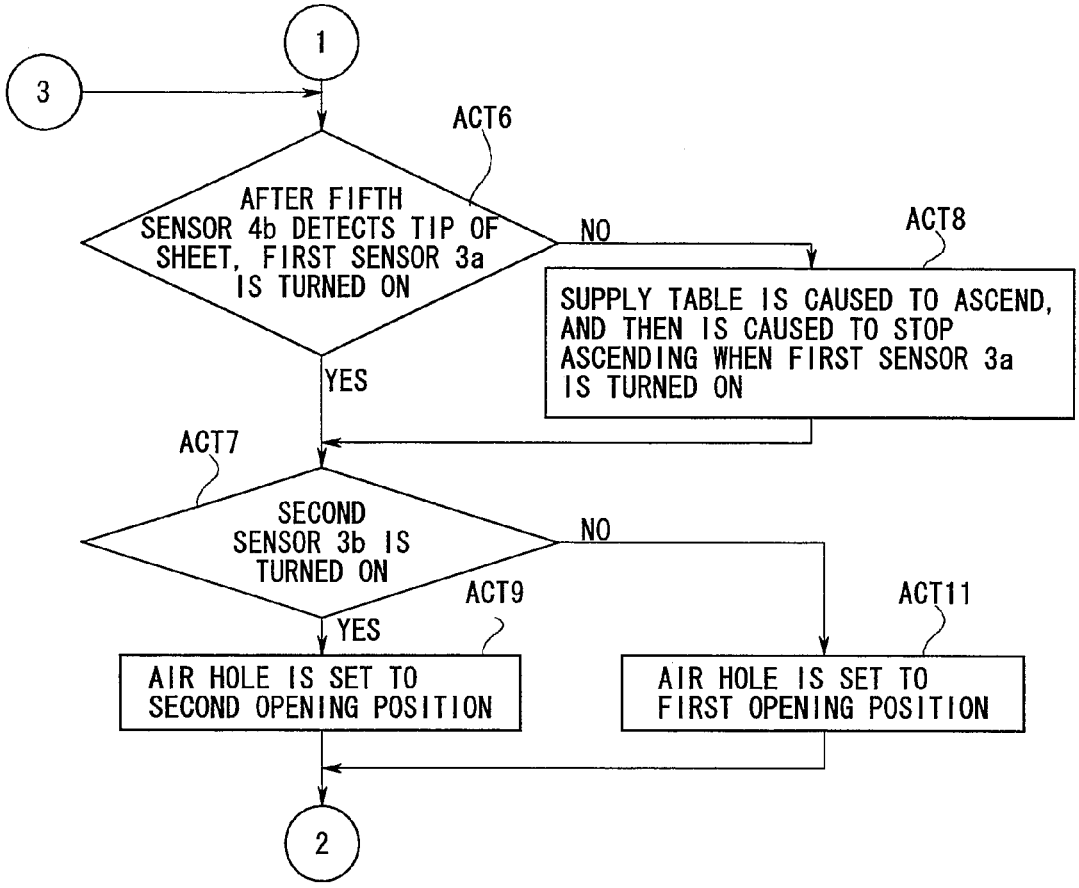
FIG. 10, which follows
Figure 11:
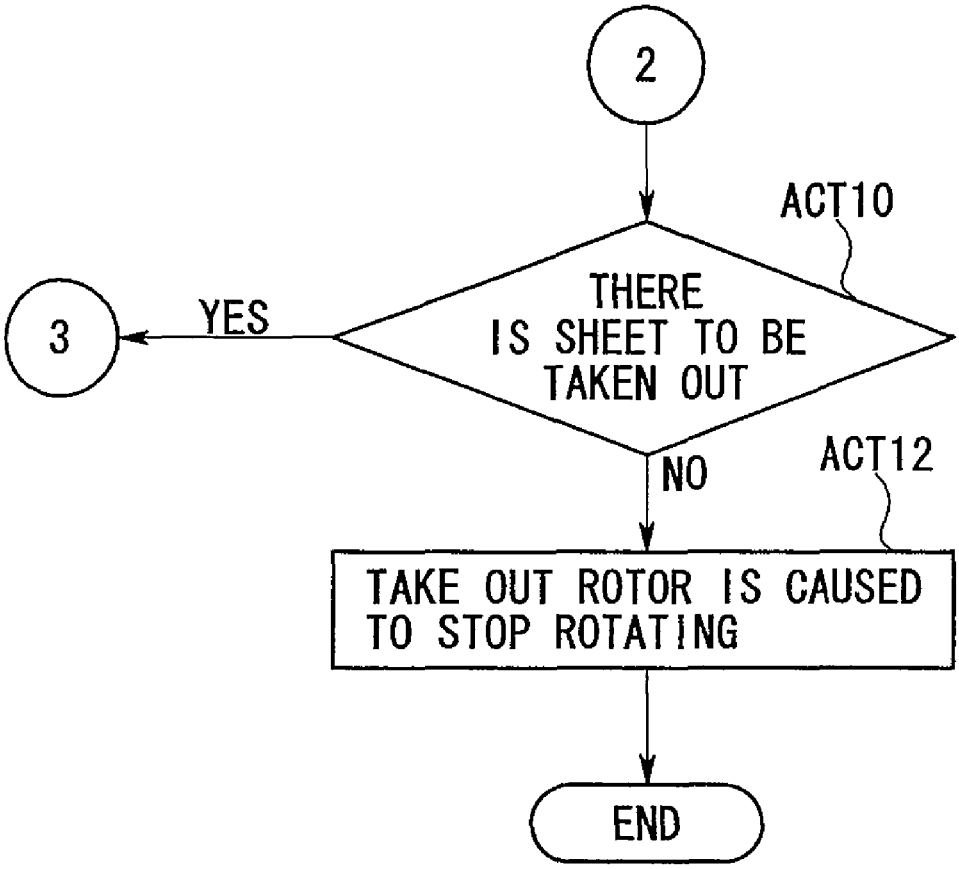
FIG. 11, which follows

After that, in ACT6, as shown in FIGS. 2, 7, and 10, after the fifth sensor 4*b* detects the tip end of the sheet P, the controller 15 determines if the first sensor 3*a* is turned on. When the first sensor 3*a* is turned on, in ACT7, the controller 15 determines if the second sensor 3*b* is turned on.

When the first sensor 3*a* is not turned on (in ACT6), in ACT8, the controller 15 controls the supply table 7 to ascend. When the first sensor 3*a* is switched on, the controller 15 causes the supply table 7 to stop ascending. In this manner, the top sheet Pa of the stacked sheets P is set again to a height position which allows the sheet Pa to be taken out. After that, the step proceeds to ACT7.

As shown in FIGS. 2, 7, 10, and 11, when the second sensor 3*b* is turned on, in ACT9, the controller 15 moves the chamber 20 to the second opening position, and in ACT10, determines if any sheet P to be taken out is left inside the supply box 5 based on the information detected by an unillustrated detecting portion.

When the second sensor 3*b* is turned off (in ACT7), the controller 15 moves the chamber 20 to the first opening position in ACT11. After that: the step proceeds to ACT10. When any sheet P to be taken out is left inside the supply box 5, the actions ACT6 onward are repeated. When there is no more sheet P left to be taken out, in ACT12, the controller 15 stops the rotation of the take out rotor 2 to finish the operation of taking out the sheet P.

With the sheet processing apparatus 100 configured as described above, the capability of the suction portion 1 of the sheet take out apparatus 110 to attract a sheet can be adjusted according to the stacked state of the sheets P to be taken out, in particular, according to the inclination of the top sheet Pa. In other words, in the case where the top sheet Pa is inclined such that the rear end side of the top sheet Pa is higher than the end portion on the take out side of the sheet, the chamber 20 is shifted to the second opening position to widen the region of the air hole facing the end portion on the take out side of the sheet toward the rear end side of the sheet. As a result, the sheet P can be securely attracted to and taken out by the take out rotor 2.

For this reason, the sheet P can be securely attracted to and stably taken out by the take out rotor 2 irrespective of whether or not the stacked sheets P on the supply table 7 have an inclination, or a higher part. Consequently, even when the sheets P each have an uneven thickness, the sheet P can be stably taken out at a high speed without decreasing the processing speed of taking out the sheets P in the course of taking out the sheets from when the supply box 5 is filled with the sheets P to when almost no sheet P is left in the supply box 5.

The opening state of the air hole 20*h* of the chamber 20 can be easily shifted with a simple method of only rotating the chamber 20 at a predetermined angle and with a simple configuration as such. Thus, the sheet take out apparatus 110 can be prevented from becoming large in size.

Furthermore, the regional end on the take out side of the air hole 20*h* is regulated to the same position by the regulation member 30 even when the chamber 20 rotationally moves to the first opening position or the second opening position. Accordingly, the sheet taken out can be separated from the take out rotor 2 in the same position and be sent to the conveyor belts 11 and 12.

Accordingly, there can be obtained the sheet take out apparatus 110 capable of stably taking out the sheet P regardless of the stacked state of the sheets P and the sheet processing apparatus 100 including the sheet take out apparatus 110.

Note that the invention is not limited to the embodiment described above and can be embodied in the practical phase by modifying the portions of the invention without departing from the scope of the invention. In addition, various embodiments can be achieved by properly combining the multiple portions disclosed in the embodiment described above. For example, some portions may be omitted from all the portions disclosed in the embodiment.

Figure 12:
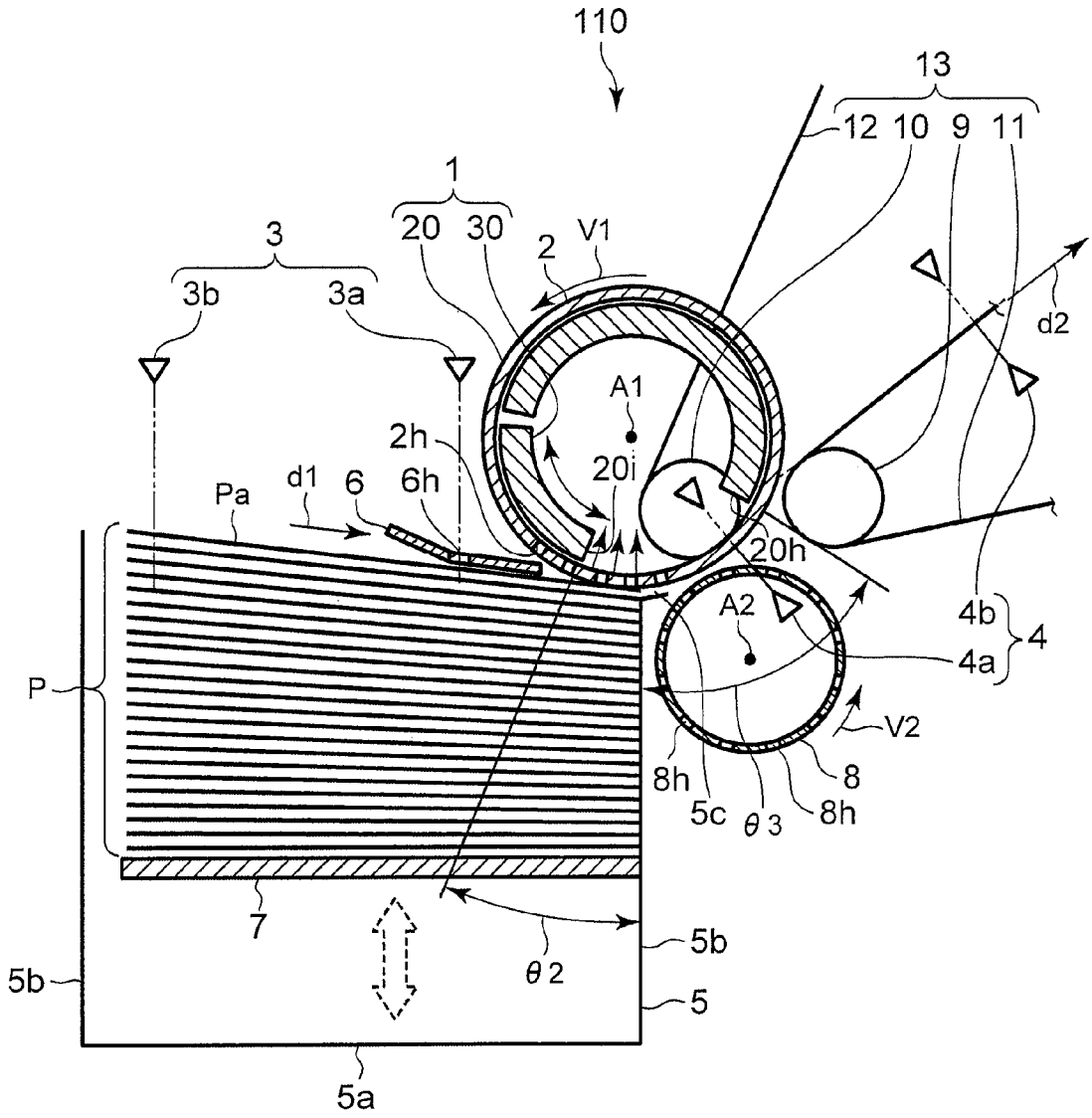
FIG. 12 is a cross-sectional view showing a sheet take out apparatus according to another embodiment of the invention.

For example, as shown in FIG. 12, in a sheet take out apparatus, a chamber 20 may be fixed and a regulation member 30 may provided so as to be rotatable, instead. In this case, the regional end on the take out side of an air hole 20*h* is regulated by the own end of the air hole 20*h*. The regulation member 30 is provided so as to cover the end portion on the sheet side of the air hole 20*h* and be movable between a first opening position and a second opening position. By shifting the regulation member 30 between the first opening position and the second opening position, the area to be blocked by the regulation member 30 is shifted. As a result, the opening area of the air hole 20*h* can be shifted.

For example, in the second opening position, one end 30*i* of the regulation member 30 is positioned so that the line passing a central axis A1 of the chamber 20 and the one end 30*i* is inclined at a second angle θ2 toward the rear end of the sheet Pa with respect to the perpendicular passing the central axis A1 and a take out port 5*c*.

Also, the types of first and second sensors 3*a* and 3*b* and the detecting method using the first and second sensors 3*a* and 3*b* are not limited to those described in the embodiment, and various modification can be made. For example, a detecting portion 3 may include three or more sensors. Accordingly an accuracy of detecting positional information on a top surface of sheets P can be improved.

What is claimed is:

1. A sheet take out apparatus, comprising:

a supply table on which sheets are stacked;

a detecting portion configured to detect a state of a top surface of the stacked sheets;

a cylindrical take out rotor which is rotatably provided so as to face an end portion on a take out side of a top sheet and partially includes a suction hole to attract the sheet, the take out rotor configured to take out the sheets one by one by attracting the end portion on the take out side of the sheet with rotation;

a suction portion which is provided inside the take out rotor and includes an air hole to attract the sheet through the suction hole, the suction portion provided so as to allow the air hole to rotationally move between a first opening position and a second opening position, the first opening position having a first distance away from the end portion on the take out side of the sheet, the second opening position having a second distance, which is longer than the first distance, away from the end portion on the take out side of the sheet; and a drive structure configured to rotationally move the suction portion to any of the first opening position and the second opening position based on state information detected by the detecting portion.

2. The sheet take out apparatus according to claim 1, wherein the suction portion includes a chamber including an outer tube in which the air hole is formed, and the chamber is provided inside the take out rotor so as to be rotationally movable between the first opening position and the second opening position around an axis that is the same as a rotational axis of the take out rotor.

3. The sheet take out apparatus according to claim 2, wherein the suction portion includes a regulation member which is fixed so as to cover one portion of the air hole and is configured to regulate a suction range of air hole so as to fix an end of the suction range opposed to an end on a take out side.

4. The sheet take out apparatus according to claim 3, wherein the regulation member is a plate having an arc-shaped cross section concentric with the chamber and is positioned between an outer circumferential surface of the chamber and an inner circumferential surface of the take out rotor.

5. The sheet take out apparatus according to claim 2, further comprising:

a rotational axis fixed to the take out rotor; and a drive shaft fixed to the chamber, wherein the rotational axis and the drive shaft extend coaxially with the chamber and the take out rotor.

6. The sheet take out apparatus according to claim 1, wherein the detecting portion includes a plurality of sensors configured to detect two positions on the top surface of the sheets, the two positions spaced apart from each other in a sheet take out direction.

7. The sheet take out apparatus according to claim 6, further comprising:

a controller configured to obtain an inclination of the top surface of the sheets based on the positional information detected by the detecting portion and to set the suction portion to any of the first opening position and the second opening position according to the obtained inclination.

8. The sheet take out apparatus according to claim 7, wherein the controller sets the suction portion to the first opening position either when the top surface of the sheets is substantially horizontal in the sheet take out direction, or when an end portion on the take out side of the top surface of the sheets rises in the sheet take out direction, and the controller sets the suction portion to the second opening position when a rear end portion of the top surface of the sheets rises in the sheet take out direction.

9. The sheet take out apparatus according to claim 1, further comprising:

a vacuum pump connected with the suction portion and configured to evacuate an inside of the suction portion.

10. A sheet processing apparatus comprising:

a sheet take out apparatus configured to take out supplied sheets one by one;

a sheet inspection device configured to inspect the sheets taken out by the sheet take out apparatus; and a sheet sorting apparatus configured to sort the sheets based on an inspection result made by the sheet inspection device, the sheet take out apparatus including:

a supply table on which the sheets are stacked;

a detecting portion configured to detect a state of atop surface of the stacked sheets;

a cylindrical take out rotor which is rotatably provided so as to face an end portion on a take out side of a top sheet and partially includes a suction hole to attract the sheet, the take out rotor configured to take out the sheets one by one by attracting the end portion on the take out side of the sheet with rotation;

a suction portion which is provided inside the take out rotor and includes an air hole to attract the sheet through the suction hole, the suction portion provided so as to allow the air hole to rotationally move between a first opening position and a second opening position, the first opening position having a first distance away from the end portion on the take out side of the sheet, the second opening position having a second distance, which is longer than the first distance, away from the end portion on the take out side of the sheet; and a drive structure configured to rotationally move the suction portion to any of the first opening position and the second opening position based on state information detected by the detecting portion.

11. The sheet processing apparatus according to claim 10, wherein the suction portion includes a chamber including an outer tube in which the air hole is formed, and the chamber is provided inside the take out rotor so as to be rotationally movable between the first opening position and the second opening position around an axis that is the same as a rotational axis of the take out rotor.

12. The sheet processing apparatus according to claim 11, wherein the suction portion includes a regulation member which is fixed so as to cover one portion of the air hole and is configured to regulate a suction range of the air hole so as to fix an end of the suction range opposed to an end on a take out side.

13. The sheet processing apparatus according to claim 12, wherein the regulation member is a plate having an arc-shaped cross section concentric with the chamber and is positioned between an outer circumferential surface of the chamber and an inner circumferential surface of the take out rotor.

14. The sheet processing apparatus according to claim 11, further comprising:

a rotational axis fixed to the take out rotor; and a drive shaft fixed to the chamber, wherein the rotational axis and the drive shaft extend coaxially with the chamber and the take out rotor.

15. The sheet processing apparatus according to claim 10, wherein the detecting portion includes a plurality of sensors configured to detect two positions on the top surface of the sheets, the two positions spaced apart from each other in a sheet take out direction.

16. The sheet processing apparatus according to claim 15, further comprising:

a controller configured to obtain an inclination of the top surface of the sheets based on the positional information detected by the detecting portion and to set the suction portion to any of the first opening position and the second opening position according to the obtained inclination.

17. The sheet processing apparatus according to claim 16, wherein the controller sets the suction portion to the first opening position either when the top surface of the sheets is substantially horizontal in the sheet take out direction, or when an end portion on the take out side of the top surface of the sheets rises in the sheet take out direction, and the controller sets the suction portion to the second opening position when a rear end portion of the top surface of the sheets rises in the sheet take out direction.

18. The sheet processing apparatus according to claim 10, further comprising:

a vacuum pump which is connected with the suction portion and configured to evacuate an inside of the suction portion.

* * * * *